US005156593A

United States Patent [19]

Green

[11] Patent Number: 5,156,593

[45] Date of Patent: Oct. 20, 1992

[54] ESOPHAGUS PROBE

[76] Inventor: Milton L. Green, R.R. 1, Mitchell, Nebr. 69341

[21] Appl. No.: 701,653

[22] Filed: May 16, 1991

[51] Int. Cl.[5] ..... A61J 7/00

[52] U.S. Cl. ..... 604/77; 604/79; 604/275; 119/72

[58] Field of Search ..... 604/77-79, 604/264, 275, 257, 218; 119/51.01, 71, 72

[56] References Cited

U.S. PATENT DOCUMENTS

| | | | |
|---|---|---|---|
| 405,137 | 6/1889 | Whitelock | 604/77 |
| 432,513 | 7/1890 | Cox | 604/79 |
| 874,239 | 12/1907 | Ratliff | 604/79 |
| 969,482 | 9/1910 | Jones | 604/79 |
| 1,238,390 | 8/1917 | Crittenden | 604/79 |
| 1,266,383 | 5/1918 | Baker | 604/79 |
| 3,774,608 | 11/1973 | Wohler, Jr. | 604/264 |
| 4,637,816 | 1/1987 | Mann | 604/77 |

FOREIGN PATENT DOCUMENTS

| | | | |
|---|---|---|---|
| 156784 | 11/1953 | Australia | 604/79 |
| 402234 | 10/1909 | France | 604/79 |
| 248023 | 5/1926 | Italy | 604/79 |
| 2155 | of 1903 | United Kingdom | 604/79 |
| 894164 | 4/1962 | United Kingdom | 604/275 |

*Primary Examiner*—Stephen C. Pellegrino
*Assistant Examiner*—Ralph A. Lewis
*Attorney, Agent, or Firm*—Zarley, McKee, Thomte, Voorhees & Sease

[57] ABSTRACT

An esophagus probe for delivery of treatment doses of material to domestic livestock directly into the animal's esophagus. This enhances an availability of the product to the animal and assures the correct dosage without risk of the animal spitting the dose out of its mouth.

9 Claims, 1 Drawing Sheet

ESOPHAGUS PROBE

BACKGROUND OF THE INVENTION

Domestic livestock, particularly cattle, are often in need of nutrients to assure proper body weight gain and growth to say nothing of general overall health of the animal. It is therefore common to dose the livestock with key nutrients required in hospitalized animals in immunity development. One of the problems in such dosing is that it is difficult to know whether the animal is getting a correct dosage. One of the reasons for this is lack of any control, if choice feeding of medicament is involved. It is therefore more common practice to avoid choice feeding and to directly dose the animals. However, even in direct dosage, the assurance that the animal in fact gets its proper dose of medicament, as opposed to it running out of the animal's mouth, or the animal spitting the medicament out, is not at all a predictable thing. There is, therefore, a need for the development of dose delivery systems which assures that an animal will get a correct dosage of product.

While oral administration is no doubt the best way to assure correct dosage, it too has its problems. One of the problems is that the animal must not only be dosed, but it must be dosed in a safe and effective manner. Perhaps the most efficient way of assuring that the animal is correctly dosed is to administer directly into the animal's esophagus. Administration directly to the esophagus assures that the animal will not spit out the dosage and that the material will be safely delivered into the animal's digestive system.

While product administration directly to the esophagus has obvious advantages, there are also some disadvantages. First, there is no currently available equipment in the industry to deliver product directly into the animal's esophagus safely. Secondly, delivery directly to the esophagus, while it enhances the availability of product to the animal and assures correct dosage, runs the risk of damage to the throat of the animal. There is, therefore, a continuing need for equipment which will allow delivery of treatment materials directly into the esophagus of domesticated livestock in a safe and effective manner.

This invention has this primary objective of fulfilling the above need.

SUMMARY OF THE INVENTION

An esophagus probe for directly delivering of treatment doses to domestic livestock. The probe is comprised of a hook-shaped conduit having a straightened mouth insert portion, a U-shaped middle portion and a handle portion. The handle portion is grasped with the straightened mouth insert portion inserted into the animal's mouth. The U-shaped middle portion contacts the lips of the mouth and prevents insertion too far down the throat.

DETAILED DESCRIPTION OF THE INVENTION

Figure 1:
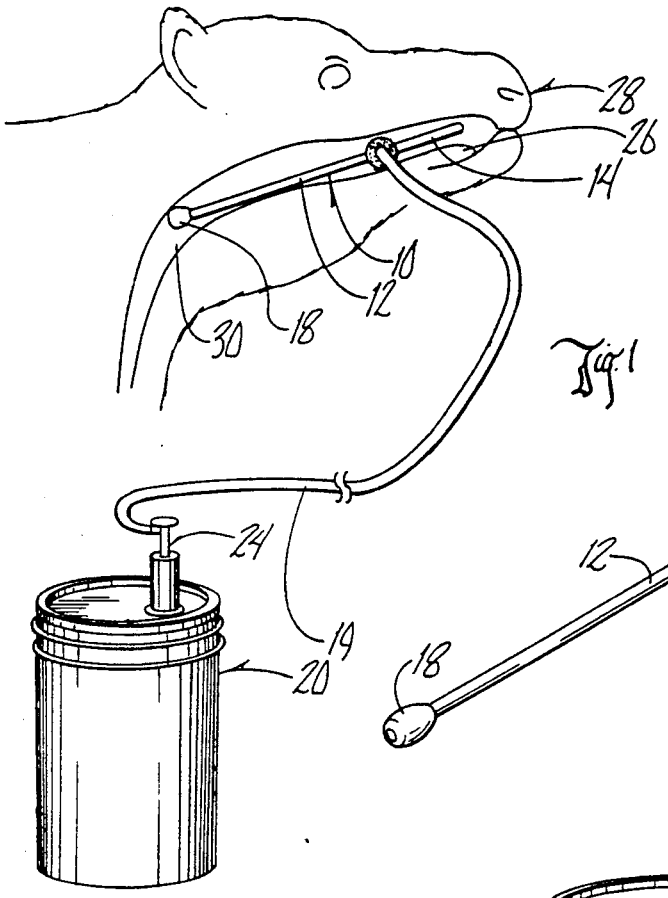
FIG. 1 shows the head of a cow with the insert in place.
Figure 2:
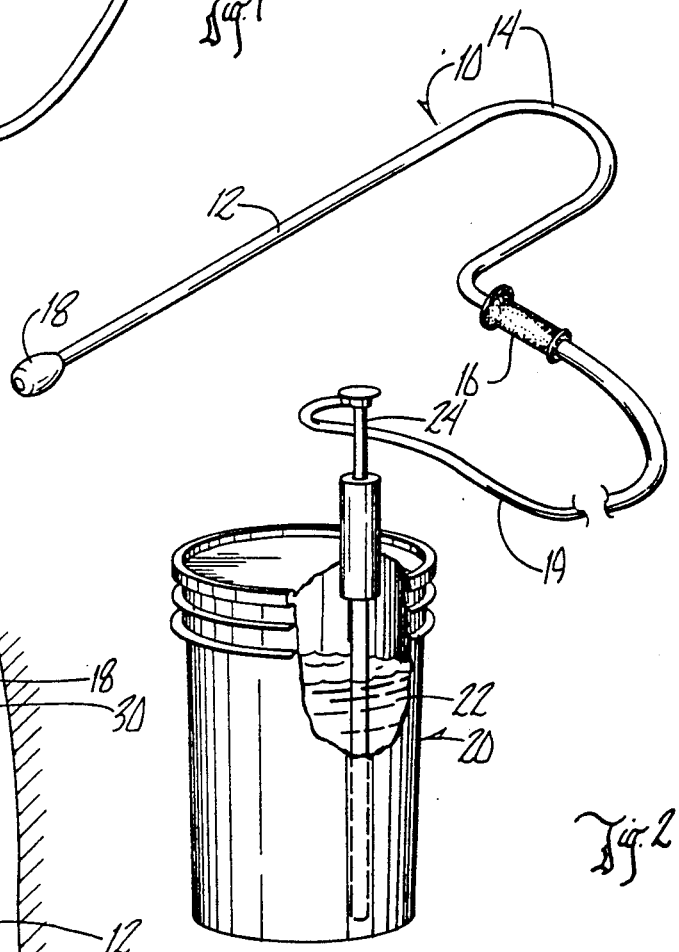
FIG. 2 is a perspective view of the insert fluidly connected to a delivery vessel.
Figure 3:
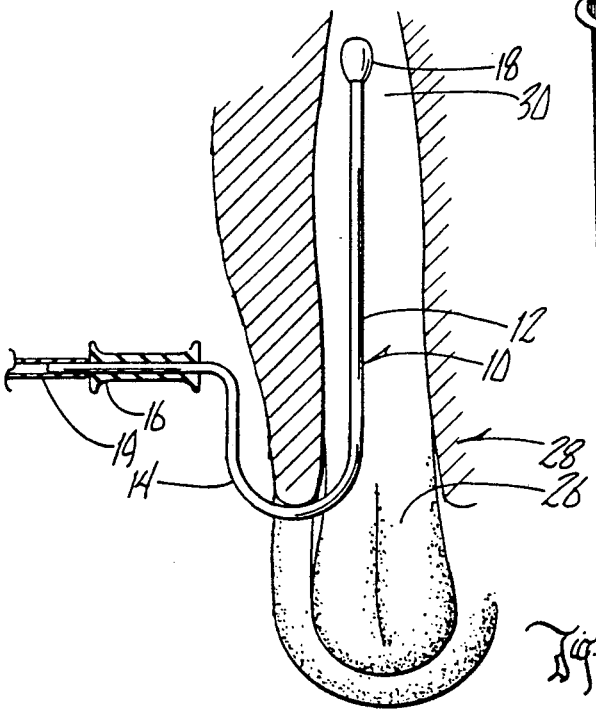
FIG. 3 is a view along line 3—3 of FIG. 1 showing how the insert is positioned with regard to the mouth and throat of a cow.

FIG. 2 shows a perspective view of the general relationship of the component parts of the esophagus probe, referred to generally as 10. The esophagus probe 10 is comprised of a hook-shaped conduit which has a straightened mouth insert portion or stem 12, a U-shaped middle portion 14 and a handle portion 16. The mouth insert portion 12 terminates in a delivery nozzle 18. As shown, handle portion 16 is in a generally transverse relationship to mouth insert portion or stem 12. The esophagus probe can be made of any suitable bendable conduit material, and is of course hollow to allow fluid to flow freely therethrough. Handle 16 is connected to a flexible hose 18 which in turn connects to a containment vessel 20. Containment vessel 20 contains a nutrient or medicament material 22. Material 22 can be dispensed via a pumping means of conventional construction, referred to generally as 24. The width across the U-shape portion 14, as illustrated in FIG. 3 is such that it may be conveniently inserted into the mouth 26 of cow 28. The length of straightened mouth insert portion 12 is such that it can conveniently extend from the mouth directly back into the esophagus 30 of cow 28 as particularly illustrated in FIG. 1. Generally this length will be from 18 inches to 36 inches, depending upon the size of the animal. Various probes may be made of different sizes to conform to the mouth and throat configuration of different-sized animals.

The device of the present invention operates in the following manner. The person doing the treatment may grasp the head of the cow 28 by grabbing one of the ears of the animal, leaving the rest of the animal's head free to permit swallowing. With the person's other hand, the end 18 of the probe 10 is inserted through the lips on one side of the animal between the teeth and the tongue as illustrated in FIG. 3. A gentle backward pressure is applied at the same time as one slowly moves the handle upward and downward facilitating a safe passage into the esophagus to the position shown in FIG. 1. Hand pressure having been applied to the vessel via pump 24, one can simply deliver through delivery nozzle 18 directly into the esophagus 30 of the animal. Direct delivery to the esophagus prevents the animal from spitting the material and assures that it will be swallowed into the digestive system. Nozzle 18 is of a cushioned polymeric material such that it prevents damage to the animal's throat. After insertion, the probe is simply pulled outwardly and away from the animal's mouth and the animal released. Medicament may then be delivered to the next animal.

It can be seen that the unique design of this probe permits administration with ease and safety for the animal with a minimum amount of restraint required on the animal by the person administering the nutrient medicament. The probe is designed to pass into the mouth to the esophagus, but not to be passed further than necessary for if efficacy of administration. The curve 14 at one end of the probe prevents further penetration beyond the esophagus. Therefore, it can be seen that the probe accomplishes all of the objectives of the present invention. The control of the length by use of the curved portion 14 prevents administering product into the trachea or the lungs and the probe is designed to provide minimum restraint to the animal and to allow a normal swallowing reflex. Therefore, it can be seen that the invention accomplishes at least all of its stated objectives.

What is claimed is:

1. An esophagus probe for delivery of treatment doses to domestic livestock, comprising:

a hook-shaped conduit having a straightened mouth insert portion, a U-shaped middle portion extending from one end of the mouth insert portion of sufficient width to conveniently allow insertion of the mouth insert portion into the mouth of a livestock animal, and a handle portion extending from the other end of the U-shaped middle portion; and said handle portion being adapted for fluid connection to a source of treatment dose material and extending in a generally transverse relationship to said mouth insert portion so that force applied to the handle portion advances the mouth insert portion down the esophagus of the livestock until the U-shaped middle portion contacts the mouth of the livestock preventing further penetration.

2. The esophagus probe of claim 1 wherein said mouth insert portion terminates with a dose delivery nozzle.

3. The esophagus probe of claim 2 wherein said dose delivery nozzle is a rubbery polymeric material generally inert to the treatment material and of sufficient flexibility to prevent harm to an animal's esophagus.

4. The esophagus probe of claim 3 wherein said handle portion includes a hand grip area.

5. The esophagus probe of claim 1 wherein the straightened mouth insert portion is of a length such that it reaches from the mouth to the esophagus of an animal to be treated.

6. The esophagus probe of claim 1 wherein the probe is fluidly connected to a vessel for containment of treatment material.

7. The esophagus probe of claim 6 wherein said vessel has an associated means for delivery of treatment material to said probe.

8. The esophagus probe of claim 7 wherein said delivery means is a hand pump.

9. The esophagus probe of claim 6 wherein said fluid connection means is a flexible hose.

* * * * *